United States Patent [19]

Hofmann

[11] Patent Number: 5,037,111

[45] Date of Patent: Aug. 6, 1991

[54] PREHISTORIC ANIMAL GAME

[76] Inventor: Elsa O. Hofmann, P.O. Box 456, Montclair, N.J. 07042

[21] Appl. No.: 575,378

[22] Filed: Aug. 30, 1990

[51] Int. Cl.[5] ..... A63B 3/00

[52] U.S. Cl. ..... 273/248; 273/252

[58] Field of Search ..... 273/248, 249, 243, 250–254

[56] References Cited

U.S. PATENT DOCUMENTS

| | | | |
|---|---|---|---|
| 4,029,320 | 6/1977 | Hausman | 273/249 |
| 4,363,628 | 12/1982 | Kirkpatrick | 273/256 |
| 4,557,485 | 12/1985 | Lardon | 273/249 |
| 4,889,345 | 12/1989 | Wawryk | 273/249 |

FOREIGN PATENT DOCUMENTS

| | | | |
|---|---|---|---|
| 2187968 | 9/1987 | United Kingdom | 273/242 |
| 2198361 | 6/1988 | United Kingdom | 273/249 |
| 2200291 | 8/1988 | United Kingdom | 273/249 |

*Primary Examiner*—Benjamin Layno

[57] ABSTRACT

An apparatus for playing a boardgame for young people and adults. The game board of the present invention comprises an open, continuous route of dinosaur footprints colored-coded or otherwise marked for contingency circumstances which occur during game play and four closed routes called "homepaths" on which only a particular player or team may enter after making at least one circuit of the outer perimeter of dinosaur footprints. The Cave in the center provides a homebase or final goal. The object of the game is to capture the most dinosaurs and to land the most dinosaurs on the Cave. An EVENT CARD, color-coded to work in conjunction with the color-coded footprints, lists the events which occur when landing on the color-coded footprint. ACTION CARDS, also color-coded, give the players the instructions to follow each time an event occurs. Many levels of the game may be played by adding question and answer cards. Another alternative object of the game is to collect a set of color-coded matching cards. The game further includes informational cards having a descriptive article. At the beginning of play, the article is read aloud and the player attempts to memorize the facts in the article. Matching cards each having a color and a statement including one of several facts found in the article are also provided. When a player lands on a marked space, a matching card is picked and the statement on the card is read, leaving out the facts. If the player can recall the article and recite the missing facts in the statement, that player collects the matching card.

3 Claims, 15 Drawing Sheets

| | |
|---|---|
| FIG. 1 | FIG. 2 |
| FIG. 3 | FIG. 4 |

EVENT CARD

PACYCEPHALASAURUS

THE BONEHEAD AWARD

FIG. 19

THE MESOZOIC ERA IS DIVIDED INTO THREE PERIODS: TRIASSIC-225-193 MILLION YEARS AGO, JURASSIC-193-136 MILLION YEARS AGO, AND CRETACEOUS-136-65 MILLION YEARS AGO.
DURING THE TRIASSIC PERIOD THERE WAS ONE VAST SUPERCONTINENT PANGAEA BREAKING INTO TWO PARTS: LAURASIA (NORTH AMERICA, EUROPE, AND ASIA) AND GONDWANALAND (SOUTH AMERICA, AFRICA, ANTARCTICA AND AUSTRALIA). DINOSAURS COULD WALK FROM ONE PART TO ANOTHER.
DURING THE JURASSIC PERIOD GONDWANALAND WAS BREAKING UP, BUT DINOSAURS COULD STILL WALK FROM ONE PART TO ANTOTHER.
DURING THE CRETACEOUS PERIOD INVADING SEAS SPLIT LAURASIA INTO ASIAMERICA (EAST ASIA AND WESTERN NORTH AMERICA AND EURAMERICA (EUROPE AND EASTERN NORTH AMERICA). SOUTHERN CONTINENTS BECAME GREAT ISLANDS AND SEASONS GREW MARKED.

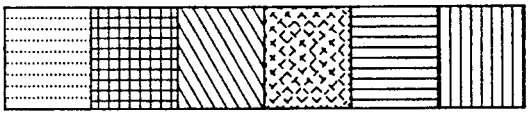

FIG. 20

AS THE AGE OF DINOSAURS WAS ENDING, SAURISCHIANS WERE OUTNUMBERED BY THE SECOND MAJOR GROUP OF DINOSAURS WHICH WERE CALLED ORNITHISCHIANS. ORNITHISCHIANS WERE BIRD-HIPPED.

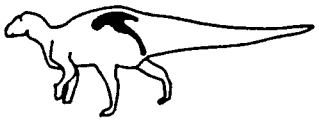

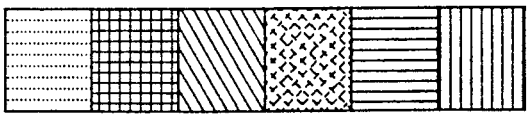

FIG. 27

1. AS THE AGE OF DINOSAURS WAS ENDING, SAURISCHIANS WERE OUTNUMBERED BY THE SECOND MAJOR GROUP OF DINOSAURS. WHAT IS THE NAME OF THE SECOND MAJOR GROUP OF DINOSAURS?

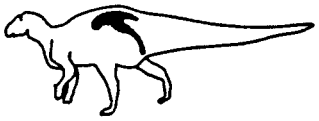

STAGE II

FIG. 28

1. DINOSAURS ARE DIVIDED INTO TWO ORDERS. GIVE THE NAME OF THE LIZARD-HIPPED ORDER?

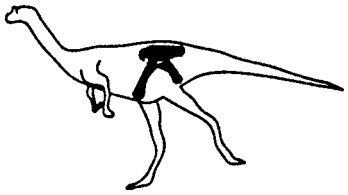

STAGE II

FIG. 29

1. NAME TWO KINDS OF LIFE THAT FLOURISHED IN THE PRE-CAMBRIAN PERIOD 3500 MILLION YEARS AGO?

STAGE III

FIG. 30

1. WHEN DID THE FIRST DINOSAURS APPEAR?

A. 200 MILLION YEARS AGO.
B. 600 " " "
C. 800 " " ".

STAGE I.

PREHISTORIC ANIMAL GAME

BACKGROUND OF INVENTION

For many centuries people have been discovering the large bones of dinosaurs, but thought they were the bones of some giant human race that once existed.

Scientific studies in the 18th century revealed that the bones belonged to extinct animals that lived many centuries ago.

As speed of travel made all parts of the globe accessible to people, interest continued to deepen in the intrinsic events that once occured on our planet. This game invention involves the intrinsic events through paleoentology. The present invention may be played without knowledge about dinosaurs or with question and answer cards in a beginning, intermediary, beginning advanced and advanced levels of playing cards. The book for the background of information used for this invention is called, *A FIELD GUIDE TO DINOSAURS* by David Lambert. The written permission to use this book is herein enclosed.

SUMMARY OF INVENTION

The present invention is a game which simulates a prehistoric safari.

Generally speaking, this game invention consists of a playing board having marked thereon a designated path of dinosaur footprints along the outer perimeter which all players must circuit at least once before entering the homepath belonging to that particular player or team and on which no other player or team may enter. Each homepath is color-coded to match a player's starting point in this game called Mud Flats. The footprints on the outer perimeter are color-coded or otherwise marked and unmarked denote many contingency circumstances listed on an Event Card when they are color-coded. Action Cards give the instructions players are to follow in each event whether they are color-coded, marked or unmarked. Players are compelled to refer to the Action Card after they have referred to the Event Card. This level of the game requires no foreknowledge about dinosaurs.

Alternate styles of the game may be played by adding sets of question and answer cards on four levels: beginners, intermediate, beginning advanced and advanced. One alternate style of the game involves using the basic game along with question and answer cards. Other alternate styles of the game may be used without using the basic structure of the game play and with alternate styles of the rules, games may be played which are straight question games. Players would then use only one dinosaur to represent their position on the playing field and the object would be to answer the most questions, at least six, before a player or team could enter their homepath. Examples of these playing cards will be shown after the detailed description.

An alternative style of the game may also be played by color-matching information cards. The basic play of the game may or may not be used depending upon the wish of the players. If the basic play of the game is used, players would select an information card each time they made their final move on each of their turns. They would first follow through on the color-coded Event listed on the Event Card or other marked space. They would then select an information card from the top of the well shuffled, face down deck. All the information on this card would be read aloud to the other players except the name of the epoch. The reverse could also apply. All the information would be read aloud except the span of years which comprise the epoch and then the players would guess the epoch. If no player could answer correctly, the player who picked the card, would keep it. If another player answered correctly, they would receive the card. Players may trade these color-coded cards each time it is their turn. In addition, to fulfilling the basic requirements of the game, players would also be required to color-match a set before being allowed to enter their homepath. There are 10 cards in each set with a color-coded map of the part of the planet on which the particular kind of dinosaur bones were found and that dinosaur is also pictured on the information card. There are three Wild Cards. Before the game begins, all the Wild Cards would be read aloud inorder to impinge the information required to answer upon the minds of each player. These cards are shown from FIG. 11 to FIG. 41. Information cards are illustrated from FIG. 42 to FIG. 45. If a straight question and answer game is played, a scorecard of dinosaur footprints is proveded and illustrated at FIG. 46. The information cards are on an intermediate level and offer the players clues both graphically and verbally.

The question and answer cards are on three levels: beginners, beginner advanced and advanced, If the basic game is played, the question and answer cards would be selected each time a player lands on a dinosaur footprint marked with a circled X. If the player can answer the question, they may move any of their dinosaurs five spaces ahead. They may split the move between two dinosaurs if they wish. There is no penalty for not being able to answer the question.

Examples of the three levels of question and answer cards will now be shown.

BEGINNERS

1. When did dinosaurs first appear?

A. 200 million years ago.
B. 600 million years ago.
C. 800 million years ago.

2. When was the last appearance of dinosaurs?

A. 65 million years ago.
B. 80 million years ago.
C. 90 million years ago.

3. How many years did dinosaurs live on Earth before they became extinct?

A. More than 10 million years.
B. More than 20 million years.
C. More than 140 million years.

ADVANCED BEGINNERS

1. Dinosaurs are divided into two orders. Give the name of the lizard-hipped order?

2. Saurischian and Ornithischian dinosaurs had a mutual ancestor. What is the name of their ancestor?

3. The saurischian dinosaur order is divided into four suborders. Name four suborders of the saurishchian dinosaur?

The advanced beginner level of question and answers illustrates a picture of the dinosaur or dinosaurs mentioned to aid the players answer.

ADVANCED

1. How long was an Astrodon and when and where did it live?

2. How tall, how long and how much did Brachiosaurus weigh?

3. When and where did Brachiosaurus live?

These cards contain no pictures to give the players clues.

Each player or team has a home path which they may not enter until they have made at least one circuit of the playing field. These homepaths are color-coded to match the starting point . No. 11 illustrates the homepath on each quadrant.

Figure 2:
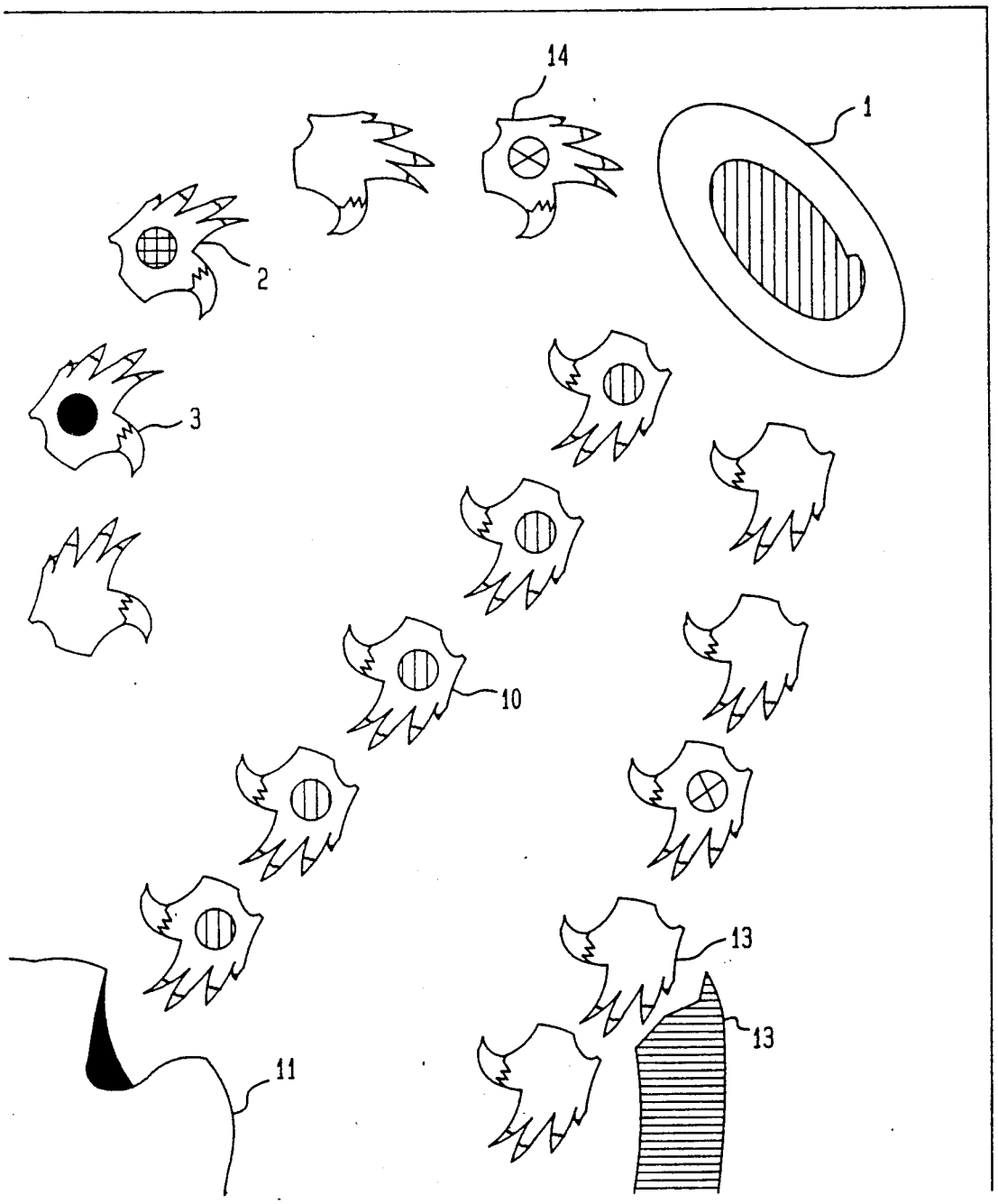
Figure 5:
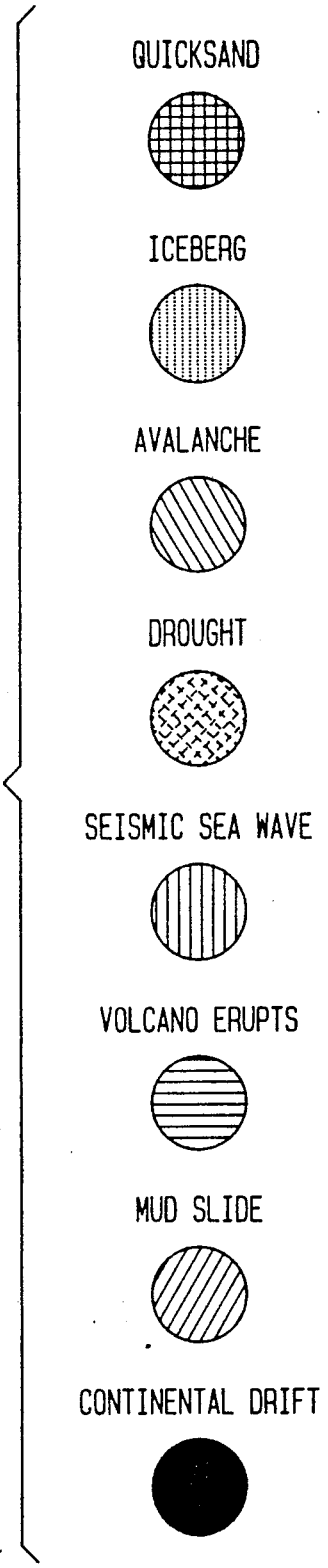

FIG. 2, No. 2 illustrates the yellow dot footprint. When landing on a color-coded footprint, players are compelled to check the Event Card which lists the events which occur each time they land on a color-coded footprint. FIG. 5 illustrates the Event Card. For yellow it states Quicksand. Players arc then compelled to check the Action Cards. Action Cards are shown from FIG. 8 through FIG. 10. The Action Cards give the instructions a player is to follow. FIG. 10 for Quicksand states: Your dinosaur is caught in quicksand. Miss one turn.

Figure 3:
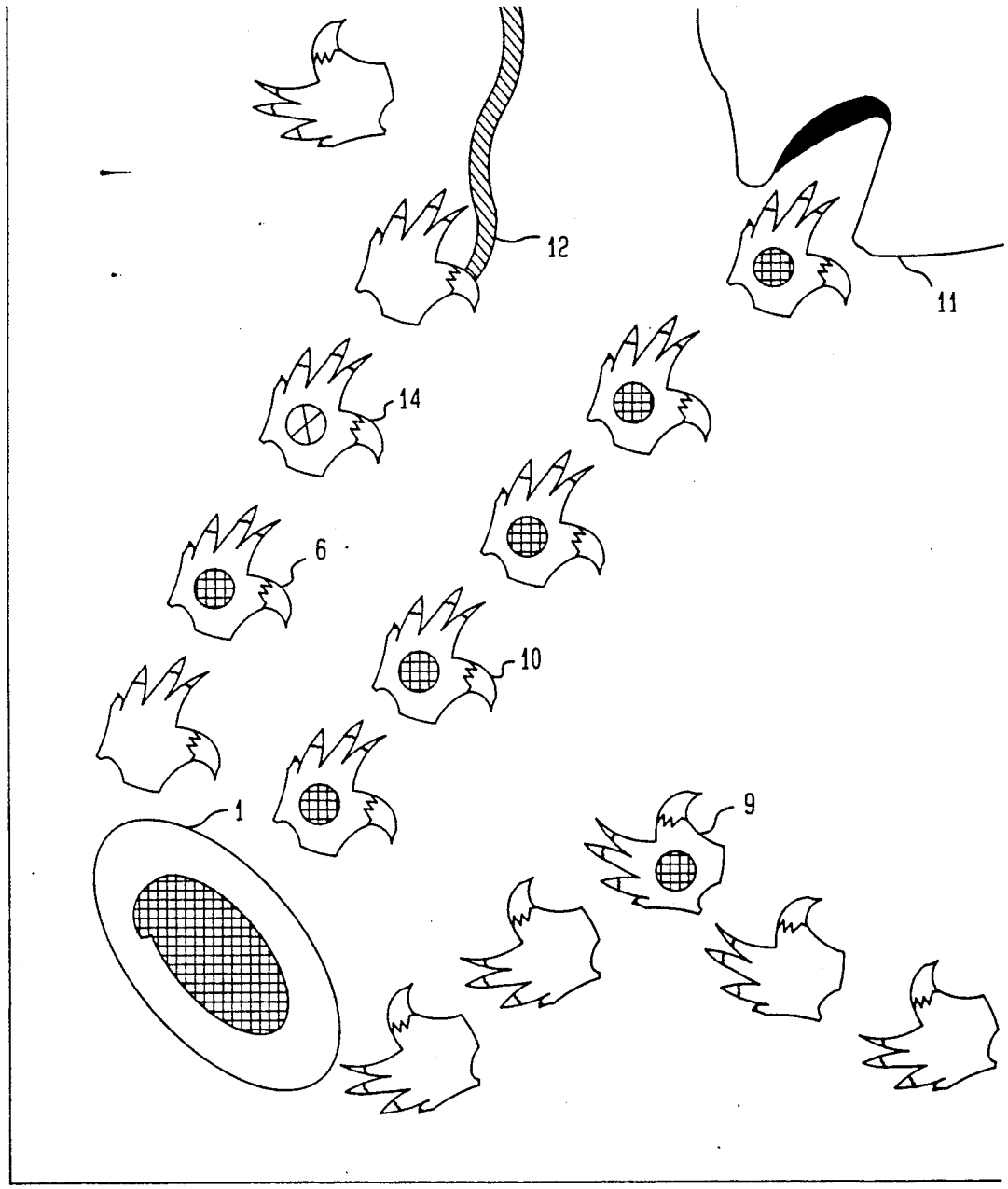

FIG. 3, No. 6 illustrates the purple dot footprint. The Event Card states Iceberg. The Action Card on FIG. 8 states: Your dinosaur has been swept into the Cave by an Iceberg Drift.

Figure 1:
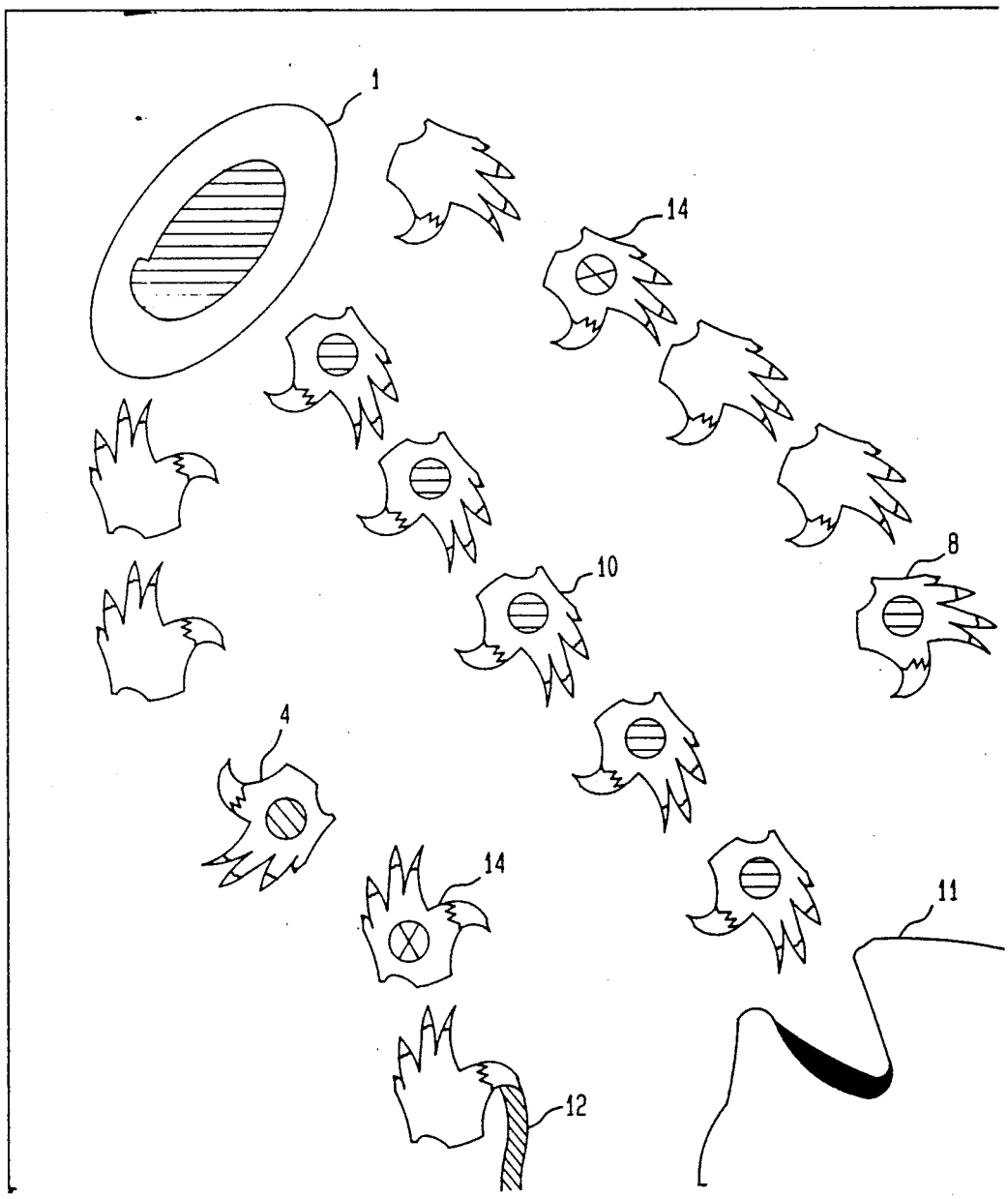
FIGS. 1, 2, 3, and 4 illustrates the playing board according to the preferred embodiment. A designated path of dinosaur footprints is provided along the outer perimeter of the playing field which is an open, continuous route used by all the players and it contains many contingency circumstances: color-coded, marked and unmarked. Players embark upon this outer route from the left of their starting point called a Mud Flat each time it is their turn. The Mud Flats are cater-cornered in each quadrant of the playing field and color-coded to designate a particular team or player. The Mud Flats are No. 1 on each quadrant.

FIG. 1 , No. 4 illustrates the green dot dinosaur footprint. The Event Card states Avalanche. The Action Card states: An Avalanche has buried your dinosaur under for one turn. You may not move any of your other dinosaurs as well.

Figure 4:
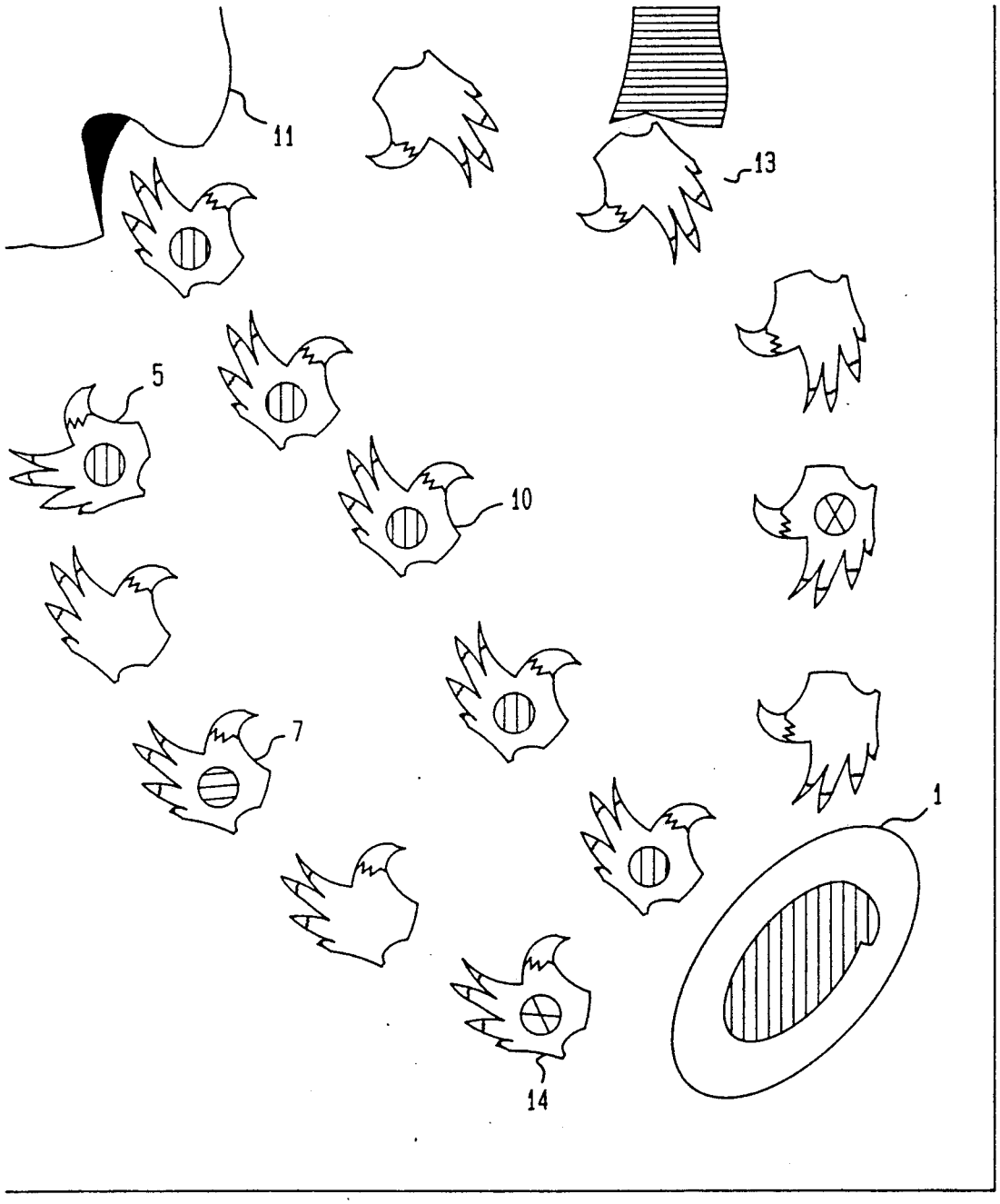

FIG. 3, No. 9 illustrates the orange dot dinosaur footprint. The Event Card states Drought. The Action Card states: Your dinosaur is in a Drought area. Move to the beginning of the waterfall. No. 13 on the playing field on FIG. 2 & FIG. 4 illustrates the waterfall.

FIG. 3, No. 5 illustrates the pink dot footprint. The Event Card states Seismic Sea Wave. The Action Card states: An approaching Seismic Sea Wave has flung your dinosaur to the opposite dinosaur footprint from where it now stands.

FIG. 1, No. 8 illustrates the blue dot dinosaur footprint. The Event Card states volcano erupts. The Action Card states: A volcano is erupting. Rumble back two dinosaur footprints.

FIG. 3, No. 7 illustrates the brown dot dinosaur footprint. The Event Card states Mud Slide. The Action Card states: A Mud Slide is approaching. Move your dinosaur to the top of the bridge. FIG. 1 and FIG. 3 No. 12 illustrates the bridge.

FIG. 2, No. 3 illustrates the black dot dinosaur footprint. The Event Card states Continental Drift. The Action Card states: When landing on the Black Dot footprint your dinosaur is on the edge of Continental Drift. Squiggle back three footprints.

FIG. 1 and FIG. 3, No. 13 illustrates the bridge. The rules state: Whenever a player lands at the foot of the bridge, they may cross over and by-pass one dinosaur footprint.

FIG. 2 and FIG. 4, No. 13 illustrates the waterfall. The rules state: Whenever a player lands at the start of the waterfall, they may pass under it and by-pass two dinosaur footprints.

FIGS. 1, 2, 3 and 4, No. 14 illustrates a circled X. The Action Card states: Whenever your dinosaur lands on a footprint marked with a circled X, you select a question card. If you can answer the question, you may move ahead five footprints. You may split the move between two dinosaurs if you wish. No penalty for not being able to answer the question.

Figure 6:
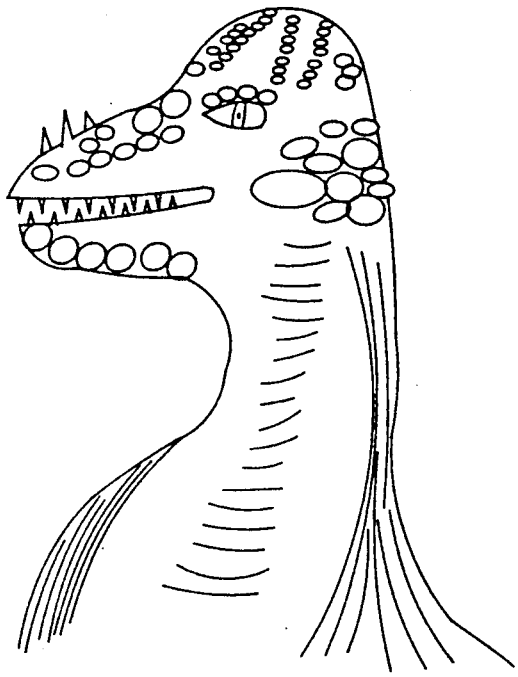

FIG. 6 illustrates the Bonehead Award. The loser of the game wins the Bonehead Award as stated in the rules.

Figure 7:
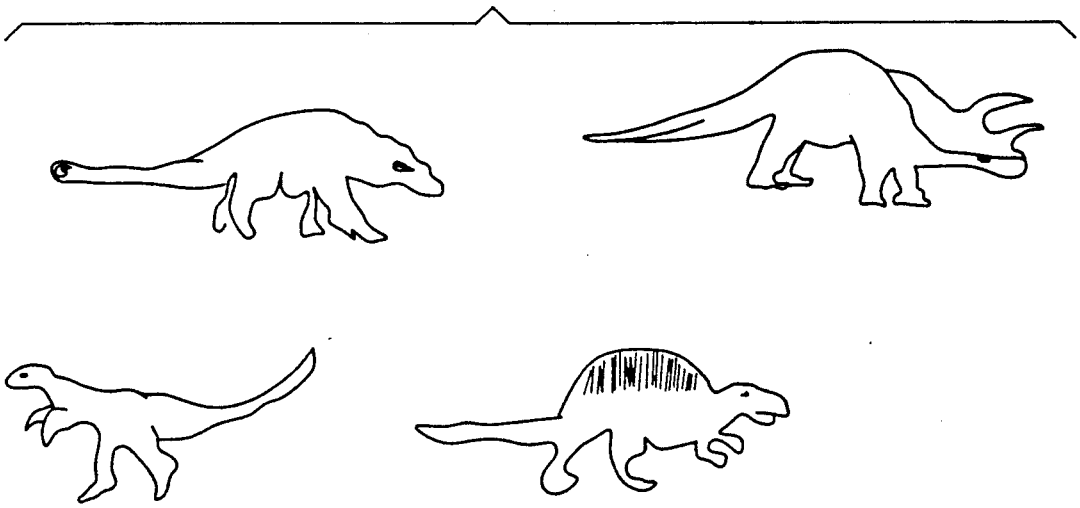

FIG. 7 illustrates dinosaur gamepieces. These are color-coded in four different colors to match a players starting point called Mud Flat and the players homepath. Each player receives at least six dinosaurs at the start of the game.

Figure 8:
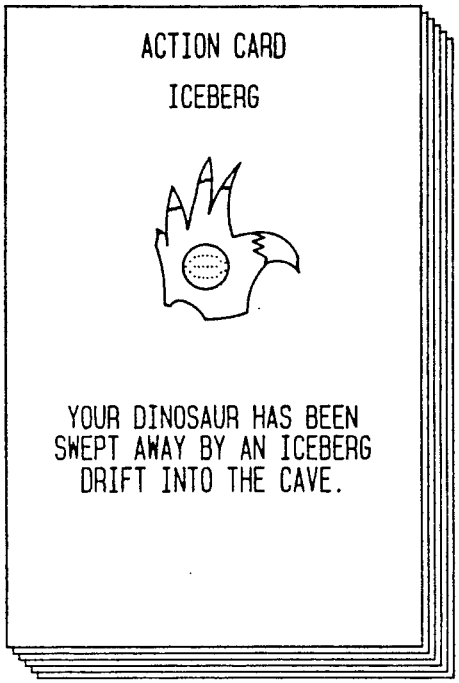
Figure 9:
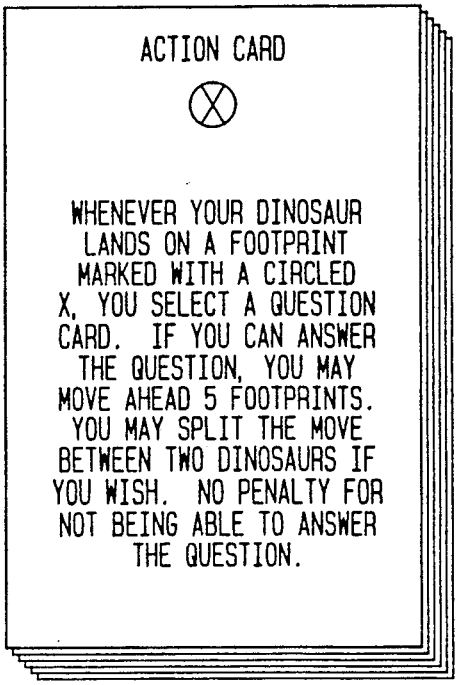
Figure 10:
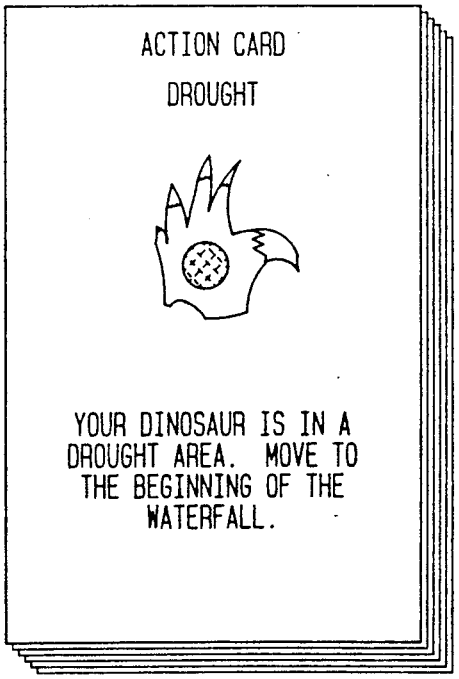
Figure 11:
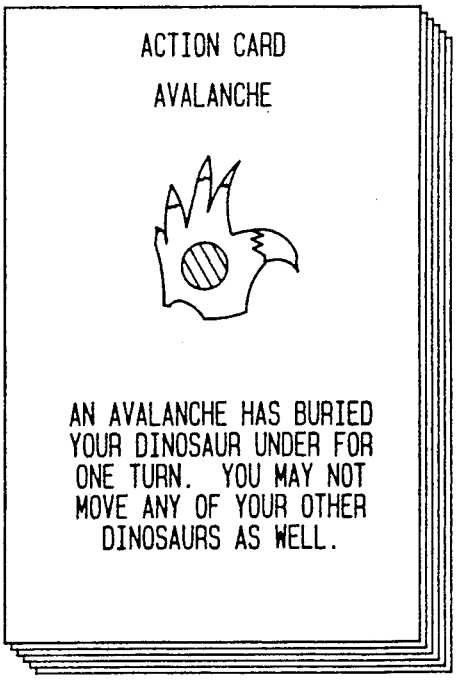
Figure 12:
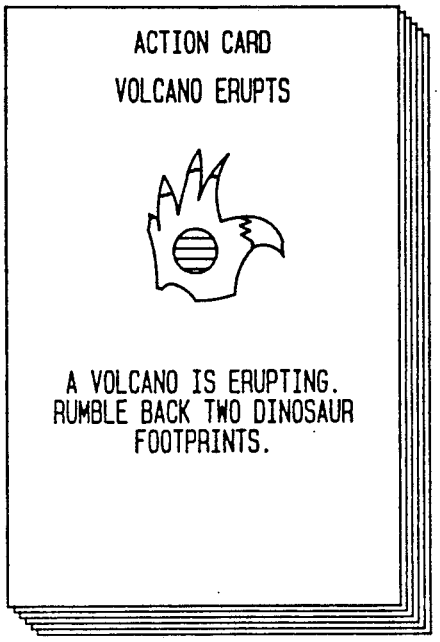
Figure 13:
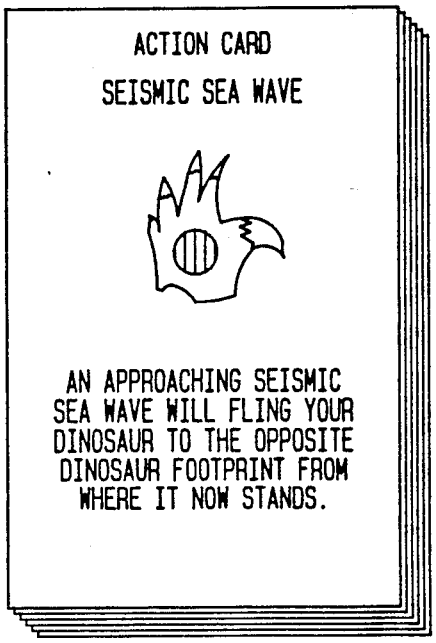
Figure 14:
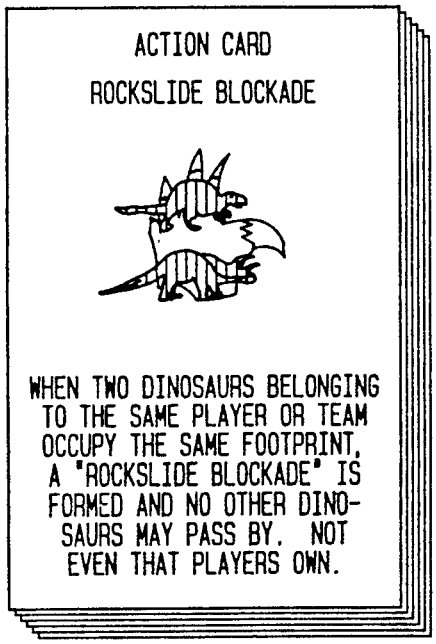
Figure 15:
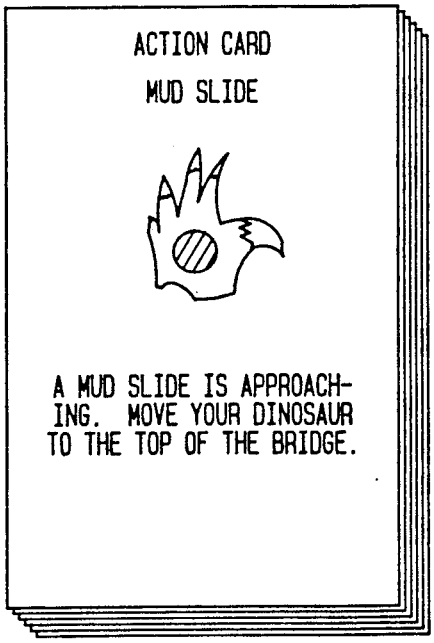
Figure 16:
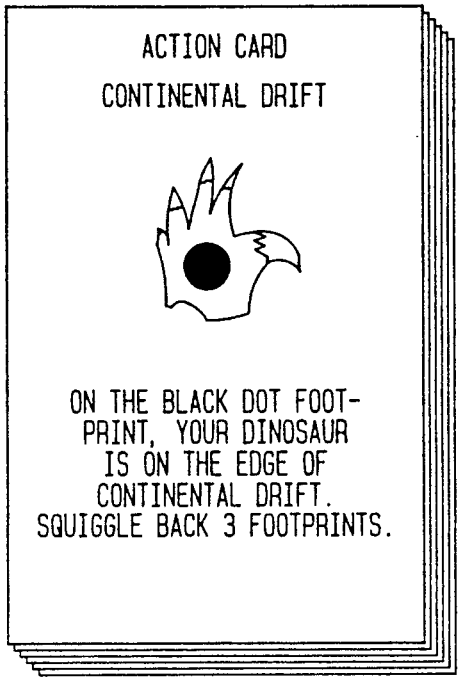
Figure 17:
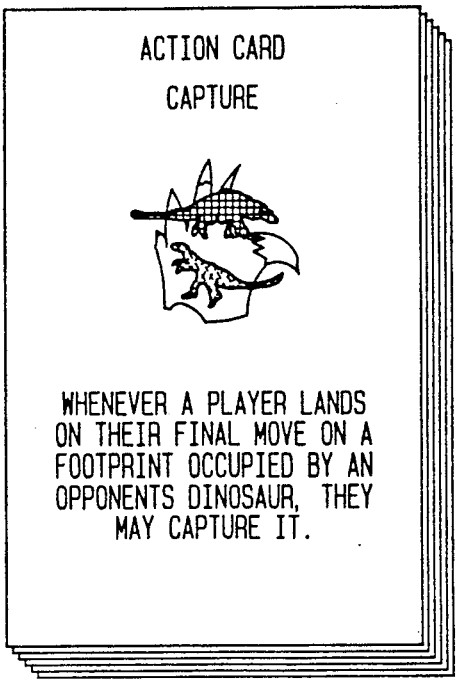
Figure 18:
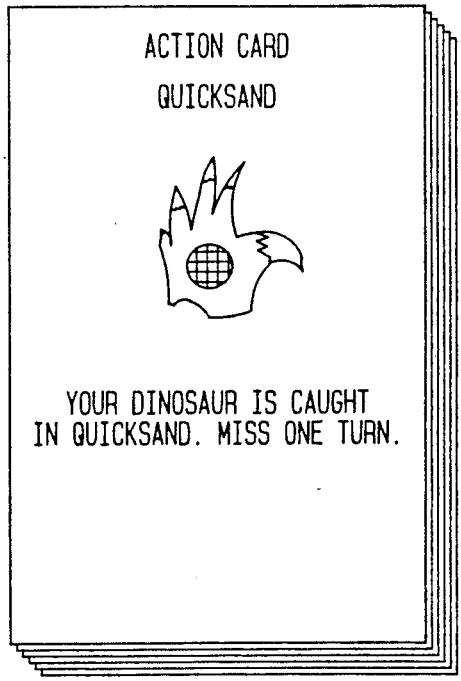
Figure 21:
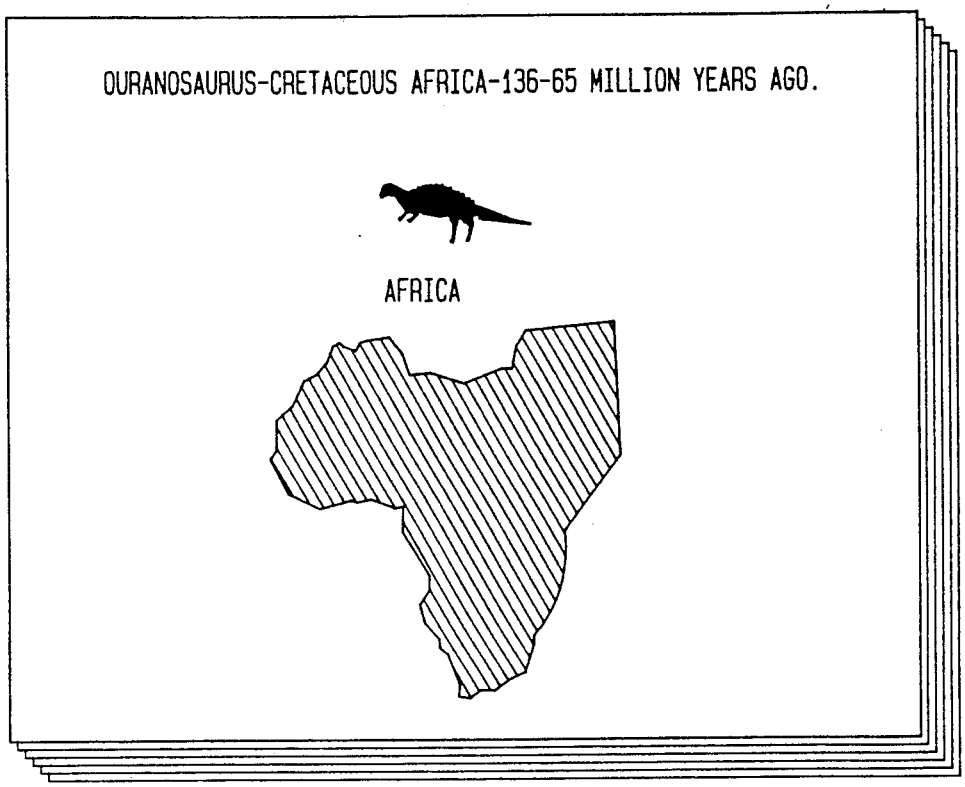
Figure 22:
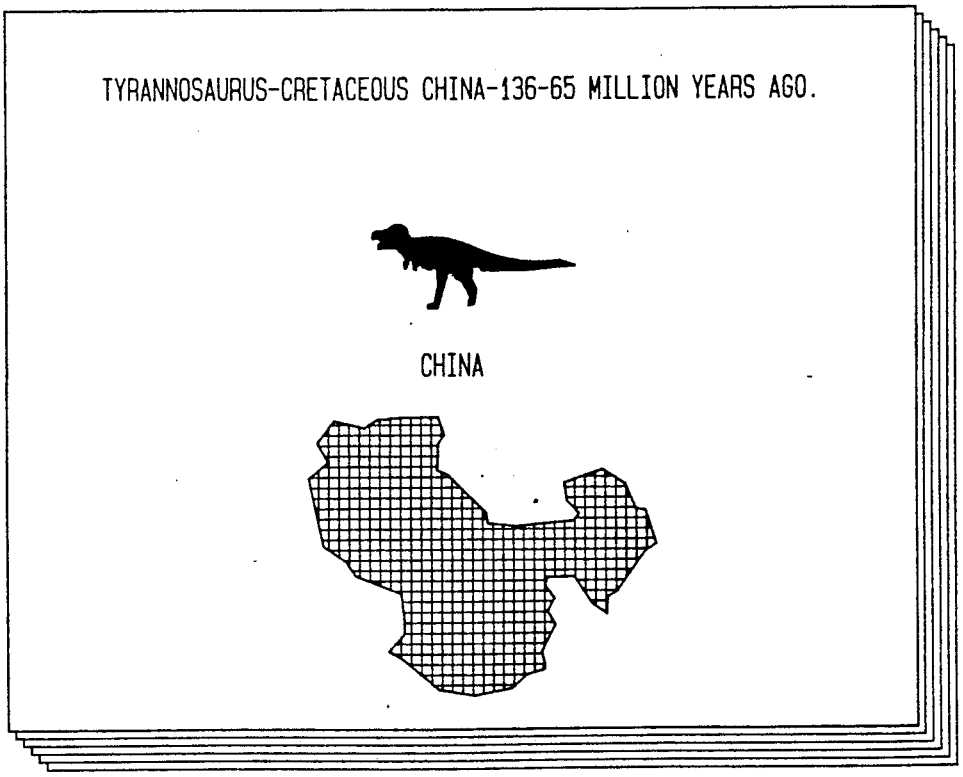
Figure 23:
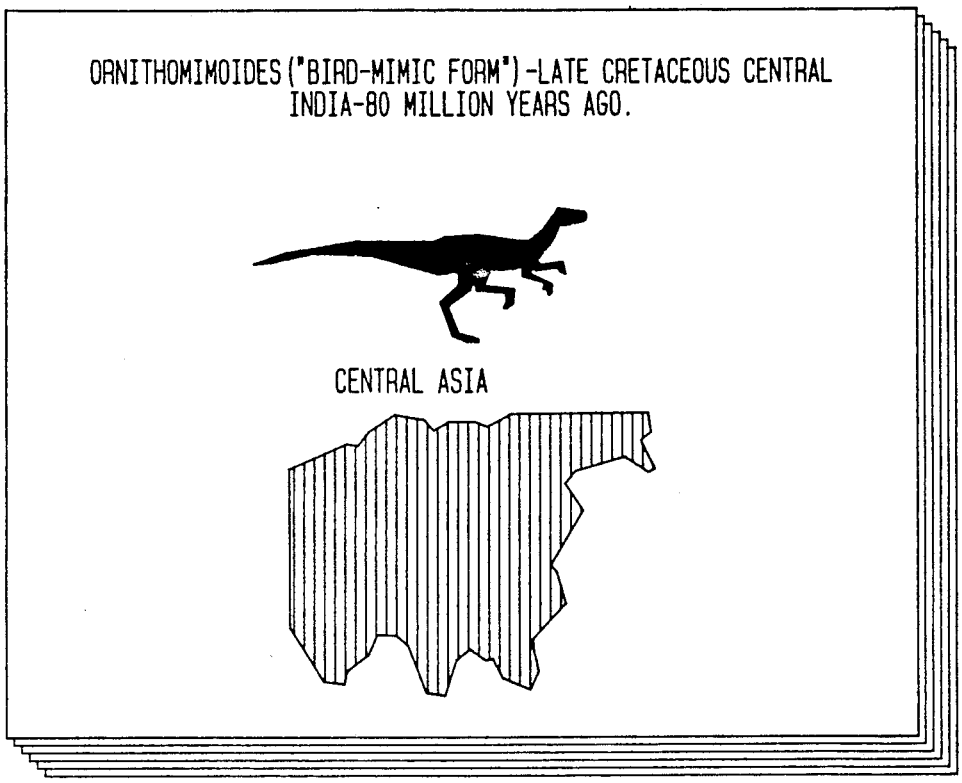
Figure 24:
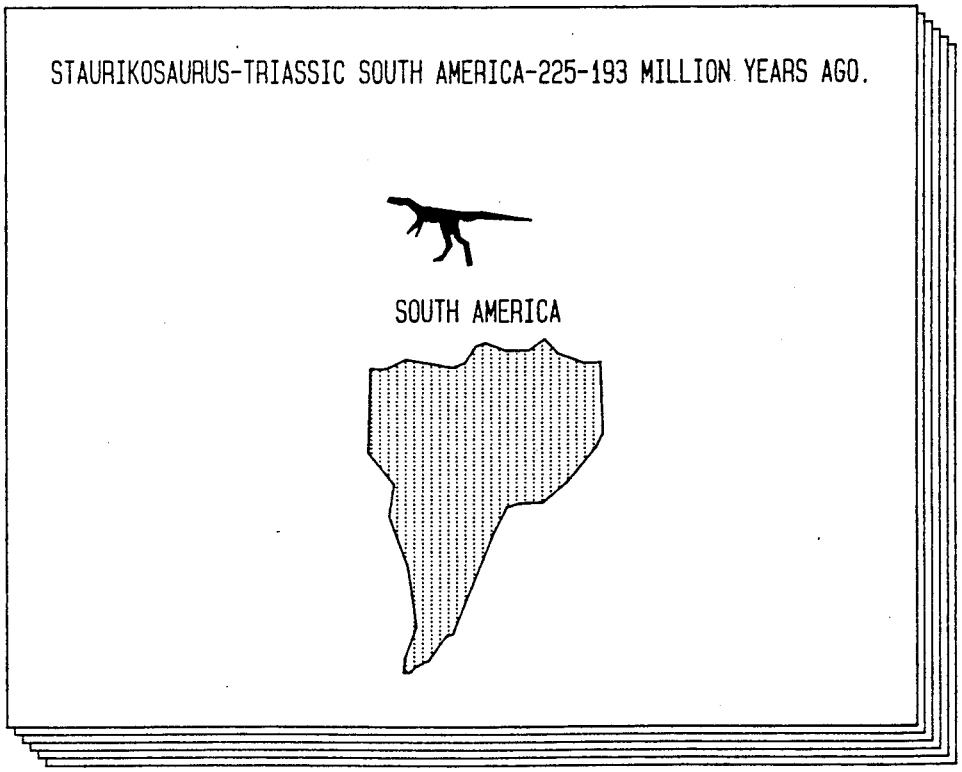
Figure 25:
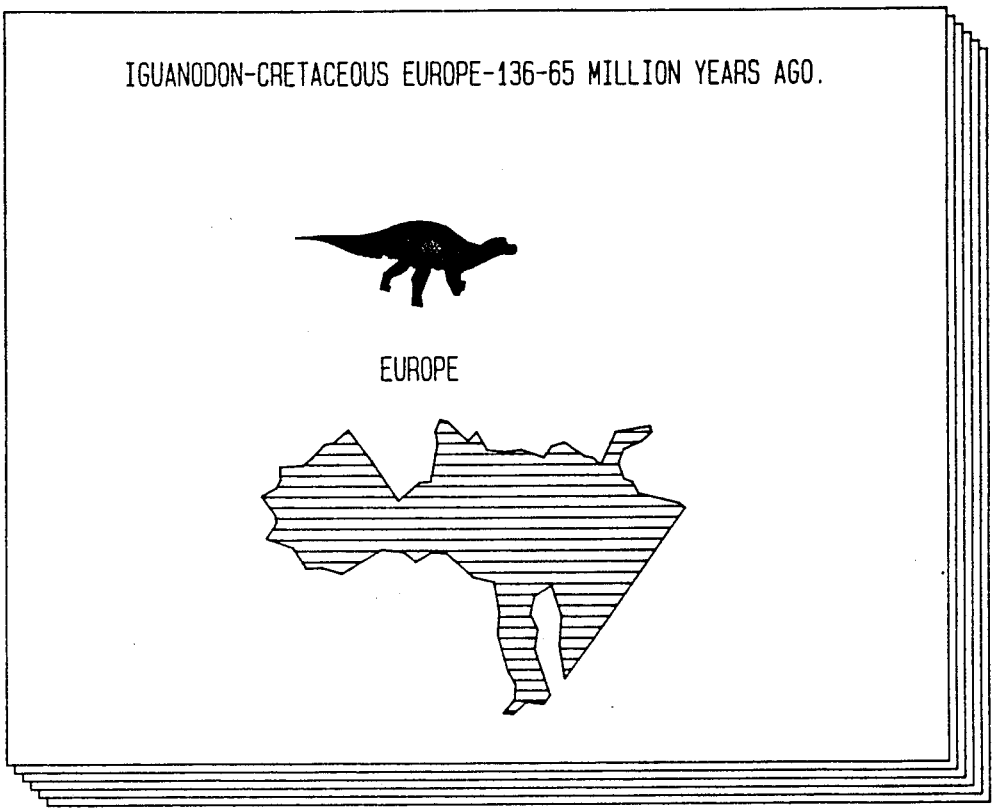
Figure 26:
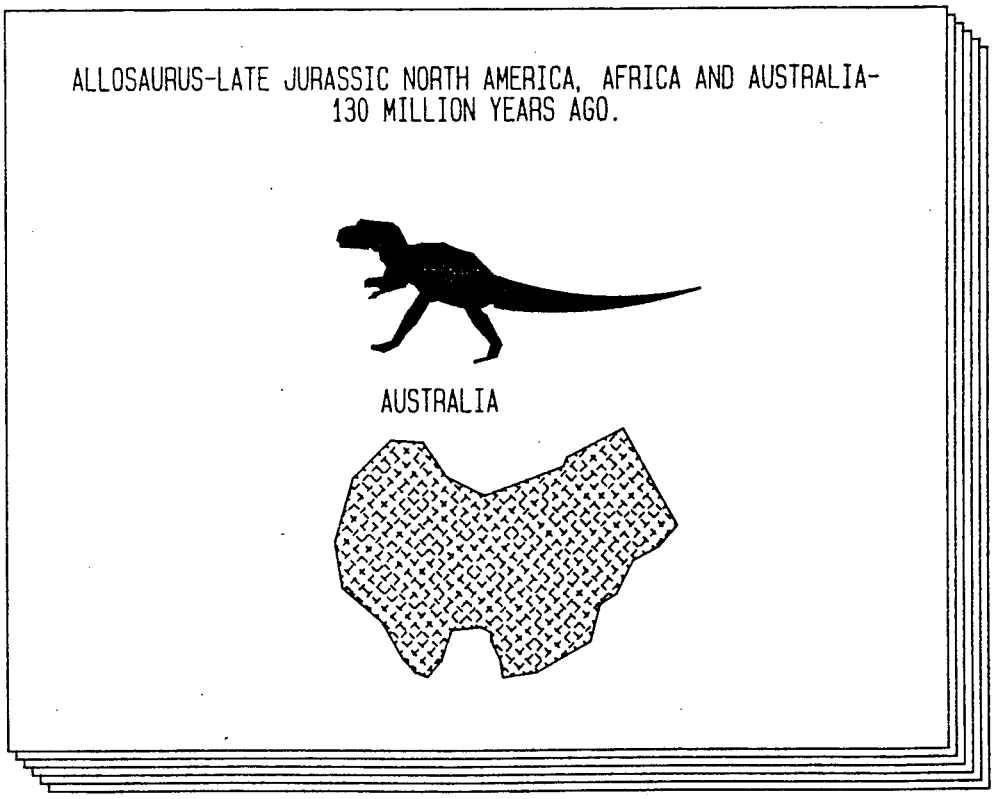
Figure 31:
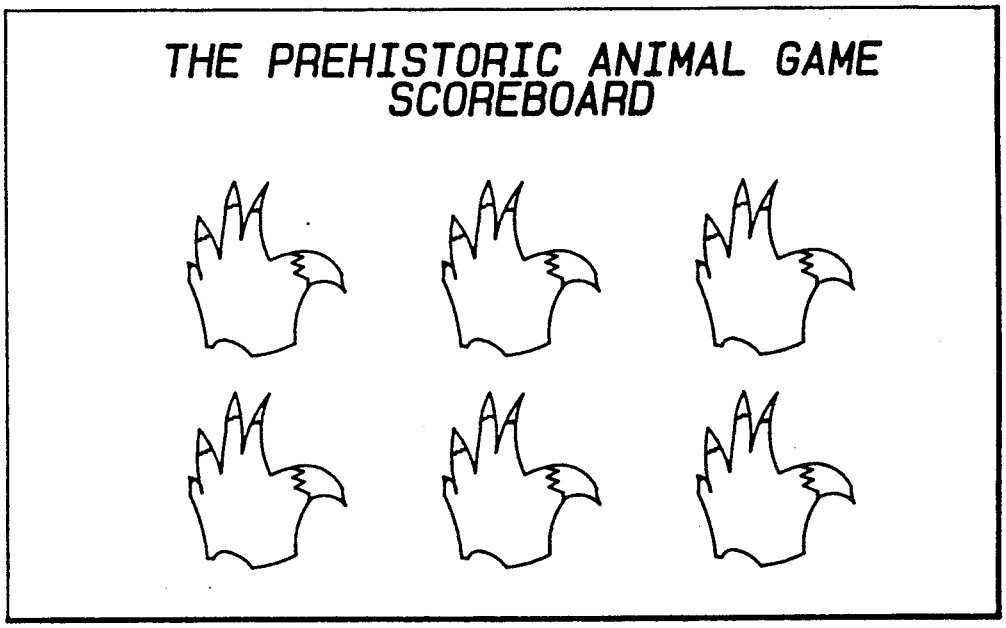

FIG. 8 through FIG. 10 illustrates the Action Cards. Each time a player lands on a color-coded footprint, they first refer to the Event card to see what event occurs. Players then refer to the appropriate color-ceded Action Card to get the instructions they are to follow in each Event. Action Cards also contain instructions for unmarked events such as capturing the opponents dinosaur and rockslide blockade. The instructions to follow upon landing on a circled X is also shown on an Action Card.

FIG. 5 illustrates the Event Card which players refer to each time they land on a color-coded dinosaur footprint.

FIG. 11 through FIG. 41 illustrates the information cards. These have color-coded maps of areas of our planet where a particular kind of dinosaur bones were found. If using this set of cards, players color-match a set of ten cards. There are three wild cards in the set.

FIG. 42 through FIG. 45 illustrates the question and answer cards.

FIG. 46 illustrates a dinosaur footprint scorecard which players may use to show score points if a straight question and answer game is played without using the basic game rules.

The rules as they are currently formulated will now be shown.

DINOSAUR SAFARI

A DETAILED DESCRIPTION OF THE PRESENT INVENTION

EQUIPMENT Twenty four dinosaur gamepieces, rules, gameboard, Action Cards, Event Card, Bonehead Award, dice and four levels of question and answer cards: Beginners, Intermediate, Beginning Advanced and Advanced.

OBJECT OF GAME The object of the game is to capture the most dinosaurs belonging to the opponents and be the player who lands the most dinosaurs on the Cave. An alternate style of the game is played by making the player or team who answers the most questions the object of the game. Another alternate style of the game is to be the first player to color match the parts of the globe where a particular dinosaur once lived. The color matching sets have 10 cards in each set color coded as follows: Yellow, orange, pink, purple, green, blue plus three wild cards.

START OF GAME Two to four teams or players may compete. Each player selects six dinosaurs of matching color and places them on the Mud Flat. Before each Mud Flat is a player's homepath. Players may not enter their homepath until they have made at least one circuit of the gameboard. Each footprint represents one move. If question cards are to be used, select the set the players wish to use for the game. These cards are then selected each time a player or team lands on the circled X. Unless players wish, there is no penalty for not being able to answer questions. If players can answer the question, they may move ahead five spaces. They may also split the move between two of their dinosaurs. Roll dice. Highest roller goes first. The other players follow in clockwise order. Players move in clockwise direction around the outer path on the playing field.

PLAY OF GAME Players may split the dice. Players move their dinosaur one space for each amount rolled on the dice or die.

EVENT CARD Each time a player lands on a color-coded space, they check the Event Card. The Event Card lists the event which occurs on every color-coded space.

ACTION CARDS After players have checked the event which occurs on the color-coded space onto which they made their final move, they select the color-coded matching Action Card and follow its instructions.

ROCKSLIDE BLOCKADE Players may create a rockslide by placing two of their dinosaurs on any unmarked and uncolor-coded space of the outer route on the playing field. In this event, no dinosaurs may pass by. Not even the player who is creating the rockslide.

CAPTURING DINOSAURS A player captures an opponents dinosaur each time they land on the same space on their final move if that space is occupied by an opponents dinosaur. The game is not over until all dinosaurs are either captured or on the Cave.

HOMEPATH Players may not enter their homepath until they have made at least one circuit of the outer route on the playing field.

CAVE Players may only enter the Cave with the exact number on the die or dice.

WINNER The winner is the player with the most dinosaurs on the Cave at the end of the game.

BONEHEAD AWARD The player with the least amount of dinosaurs on the Cave, wins the bonehead award.

ALTERNATE STYLES OF THE GAME Alternate sty-les of the game may be played by adding question and answer cards. The question and and answer cards may be used in conjunction with the basic game or with rules to a separate game which uses the same gameboard. If question and answer cards are used with the basic game, they are selected each time a player lands on the circled X. If a player can answer the question, they may move their dinosaur ahead five s-paces. They may split the move between two of their dinosaurs if they wish.

Globally color-coded dinosaur cards. If players use the globally color-coded cards with the basic game, the object of the game adds the contingency circumstance of having to match at least one set of color-coded map cards before they may enter their homepath.

SETS Each set consists of ten cards. There are three wild cards.

Wild Cards If the globally color-coded cards are used, the wild cards are read aloud before the game begins. The purpose is to impinge upon the minds of the players the dates and the name of the epoch.

PLAY OF GAME Shuffle map cards well and place face down near the gameboard. Each time a player lands on a space which is color-coded or otherwise marked, in addition to carrying out the action card instruction, they select a global-map card. All the information written on the card is read aloud to the other players except the name of the epoch. The other players try to guess the name of the epoch. If any player can guess the name of the epoch correctly, they may have the card selected. If no player can guess the name of the epoch correctly, the player who selected the card may keep it. Players may trade cards each time it is their turn. The first player to collect a set may then enter their home path. Players may use just one dinosaur for this game and eliminate capturing of dinosaurs AND "Rockslide Blockade".

As revealed in the above disclosure, this game affords young people and adults entertainment as well as an opportunity to learn about dinosaurs.

I claim:

1. A board game apparatus comprising:

a board having marked thereon a playing path divided into a plurality of spaces;

a plurality of playing paths;

one playing path being an open continuous route color-coded or otherwise marked and unmarked for each contingency circumstance;

a plurality of playing paths color-coded to designate they belong to a particular player or team said routes being closed;

a plurality of starting points, one for each player or team from which each homepath leads to the final homebase;

a plurality of playing pieces to represent each player or team on the playing field designating their position;

a random generating means which by chance designates the number of spaces each player or team may move;

a plurality of informational cards comprising a descriptive article disclosing several facts of a particular subject matter;

a plurality of matching cards divided into a plurality of distinguishable sets, wherein all the matching cards of any one set have only one common color distinguishable from the common color of the other sets; each of said matching cards comprising a statement including one of said several facts found in said article.

2. The board game apparatus of claim 1 further comprising;

an Event Card which lists a color-coded event to match the color-coded space the player has landed on;

Action Cards which work in conjunction with the spaces on the playing field and give the players instructions for the action the player is to carry out on color-coded spaces, marked spaces and unmarked spaces.

3. The board game apparatus of claim 1 further comprising;

question and answer cards on several levels;

one set of question and answer cards on an advanced level;

one set of simple questions and answers the answers designated by A., B., or C. and some of the cards containing illustrations to give the players clues to the answer;

a scorecard to be used for straight question and answer games for scoring points;

a bonehead award for the loser of the game.

* * * * *